US011993909B2

(12) United States Patent
Zhu

(10) Patent No.: US 11,993,909 B2
(45) Date of Patent: May 28, 2024

(54) CONSTRUCTION METHOD FOR REINFORCING AND REPAIRING STEEL PIPE PILE FOR OFFSHORE WIND POWER

(71) Applicant: ZHEJIANG UNIVERSITY, Zhejiang (CN)

(72) Inventor: Ronghua Zhu, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 0 days.

(21) Appl. No.: 17/890,274

(22) Filed: Aug. 18, 2022

(65) Prior Publication Data

US 2023/0366169 A1 Nov. 16, 2023

(30) Foreign Application Priority Data

May 14, 2022 (CN) ..... 202210523689.0

(51) Int. Cl.
*E02D 5/64* (2006.01)
*E02D 37/00* (2006.01)
*E02D 5/22* (2006.01)

(52) U.S. Cl.
CPC ..... *E02D 5/64* (2013.01); *E02D 37/00* (2013.01); *E02D 5/226* (2013.01); *E02D 2250/00* (2013.01); *E02D 2300/0029* (2013.01)

(58) Field of Classification Search
CPC ..... E02D 5/226; E02D 5/526; E02D 5/60; E02D 5/64; E02D 37/00
USPC ..... 405/211, 211.1, 216, 251
See application file for complete search history.

(56) References Cited

U.S. PATENT DOCUMENTS 1,339,535 A * 5/1920 White ..... E02D 15/06 425/454
1,888,073 A * 11/1932 Collins ..... E02D 5/60 405/216
3,736,759 A * 6/1973 Blose ..... E02D 5/60 264/45.3
4,114,388 A * 9/1978 Straub ..... E02D 5/60 405/216
4,116,013 A * 9/1978 Hellmers ..... E02D 5/64 405/216
4,439,070 A * 3/1984 Dimmick ..... E02D 5/64 24/271
4,543,764 A * 10/1985 Kozikowski ..... E04G 23/0218 52/309.3

(Continued)

*Primary Examiner* — Frederick L Lagman
(74) *Attorney, Agent, or Firm* — JCIPRNET

(57) ABSTRACT

A construction method for reinforcing and repairing a steel pipe pile for offshore wind power includes the following steps. Installing multiple support ribs on an outer wall of a steel pipe pile to be repaired along a circumferential direction. Placing multiple support plate components on the support ribs and performing splicing along the outer wall of the steel pipe pile to form an annular support plate assembly. Installing multiple hoop cylinder components on the support plate assembly, performing splicing along the outer wall of the steel pipe pile to form an annular hoop cylinder assembly, and forming a grouting cavity between the hoop cylinder assembly and the steel pipe pile. Connecting grouting pipelines to grouting ports of the hoop cylinder assembly, and performing a grouting operation. After grouting, forming a reinforcement and repair structure on the outer wall of the steel pipe pile when grouting materials are solidified.

8 Claims, 5 Drawing Sheets

(56) References Cited

U.S. PATENT DOCUMENTS

| | | | | | |
|---|---|---|---|---|---|
| 4,679,964 | A * | 7/1987 | Blandford | E21B 33/037 | 166/356 |
| 4,830,540 | A * | 5/1989 | Abrams | E02B 17/0004 | 405/195.1 |
| 4,993,876 | A * | 2/1991 | Snow | E02B 17/0034 | 52/834 |
| 5,226,751 | A * | 7/1993 | Doleshal | E02D 5/60 | 405/211.1 |
| 5,337,469 | A * | 8/1994 | Richey | E02D 5/64 | 52/514 |
| 5,591,265 | A * | 1/1997 | Tusch | E02D 31/06 | 118/404 |
| 6,536,991 | B1 * | 3/2003 | Trader | E02D 5/64 | 405/211.1 |
| 7,104,219 | B2 * | 9/2006 | Frantz | A01K 61/54 | 119/221 |
| 8,628,275 | B1 * | 1/2014 | Trader | E02D 5/64 | 405/211 |
| 8,888,414 | B2 * | 11/2014 | Hall | E02D 5/48 | 405/251 |
| 2003/0085482 | A1 * | 5/2003 | Sincock | E02D 5/64 | 264/32 |

* cited by examiner

CONSTRUCTION METHOD FOR REINFORCING AND REPAIRING STEEL PIPE PILE FOR OFFSHORE WIND POWER

CROSS-REFERENCE TO RELATED APPLICATION

This application claims the priority benefit of China application no. 202210523689.0, filed on May 14, 2022. The entirety of the above-mentioned patent application is hereby incorporated by reference herein and made a part of this specification.

BACKGROUND

Technical Field

The present invention belongs to the field of offshore wind power engineering, and in particular relates to a construction method for reinforcing and repairing a steel pipe pile for offshore wind power.

Description of Related Art

With the continuous development of offshore wind power, the construction of offshore wind farms is also expanding. There are as many as dozens of wind turbines in a large wind farm. As a result, during the development and operation and maintenance of offshore wind power, the probability of collision between ships and wind turbine foundations is increased. In addition, the construction of offshore wind farms is greatly affected by weather factors, and has a long period. In case of extreme weather, it is very easy for ships to collide with wind turbines.

The marine environment is complex and changeable, such that the construction is difficult. In order to facilitate the construction, most of structures adopt steel structure types. Compared with solid components, hollow steel pipes and steel structural components are smaller in rigidity. When disasters such as ship collision occur, steel structures are easily damaged and deformed to affect normal service of wind turbines. In engineering, grout repair, hoop repair and grout-hoop repair are often used. In the actual repair process, it was found that grout repair requires a larger amount of engineering and a higher cost, while hoop repair requires high precision and can better play its repair advantages only when a component is closely attached. Grout-hoop repair is allowed to have larger errors in the manufacturing process, and is widely popular at home and abroad, but there are still some engineering problems urgently to be solved in actual construction operations.

SUMMARY

In order to make up for the deficiencies in the prior art, the present invention provides a technical solution of a construction method for reinforcing and repairing a steel pipe pile for offshore wind power.

A construction method for reinforcing and repairing a steel pipe pile for offshore wind power includes the following steps:

step S1: installing a plurality of support ribs on an outer wall of a steel pipe pile to be repaired along a circumferential direction;

step S2: placing a plurality of support plate components on the support ribs and performing splicing along the outer wall of the steel pipe pile to form an annular support plate assembly;

step S3: installing a plurality of hoop cylinder components on the support plate assembly, performing splicing along the outer wall of the steel pipe pile to form an annular hoop cylinder assembly, and forming a grouting cavity between the hoop cylinder assembly and the steel pipe pile;

step S4: connecting grouting pipelines to grouting ports of the hoop cylinder assembly, and performing a grouting operation; and step S5: after grouting, forming a reinforcement and repair structure on the outer wall of the steel pipe pile when a grouting material is solidified.

Further, in the step S1, the support ribs are fixed to the outer wall of the steel pipe pile by welding.

Further, in the step S1, magnetic adsorption pieces are fixed to the support ribs and adsorbed to the outer wall of the steel pipe pile, such that the support ribs are pre-positioned, and that the support ribs are welded.

Further, in the step S2, the plurality of support plate components are welded to form the support plate assembly.

Further, in the step S2, the support plate components are fixed to the outer wall of the steel pipe pile by welding.

Further, in the step S2, the support plate assembly includes two support plate components.

Further, in the step S3, the plurality of hoop cylinder components are connected by high-strength fasteners to form the hoop cylinder assembly.

Further, in the step S3, a bottom portion of the hoop cylinder assembly is connected to the support plate assembly by high-strength fasteners.

Further, in the step S4, an upper end of the hoop cylinder assembly is formed with grout overflow ports, such that whether the grouting operation is completed is judged by observing whether the grouting materials overflow from the grout overflow ports during grouting.

Further, an inner wall of the hoop cylinder assembly is provided with first reinforcement keys, the outer wall of the steel pipe pile is welded with second reinforcement keys, and the hoop cylinder assembly is installed on the steel pipe pile.

Compared with the prior art, the present invention has the following beneficial effects.

1. The repair method according to the present invention is simpler and more convenient to operate.

2. According to the present invention, support is provided by the support ribs and the support plate assembly, the grouting cavity is formed by the hoop cylinder assembly and then is grouted by using the grouting ports, and the reinforcement and repair structure is formed on the outer wall of the steel pipe pile when the grouting material is solidified, which has good durability and overall cooperative work performance, can reduce maintenance costs, and protects the safety of an offshore wind power structure.

DESCRIPTION OF THE EMBODIMENTS

The present invention is further described below in conjunction with the accompanying drawings.

Figure 1:
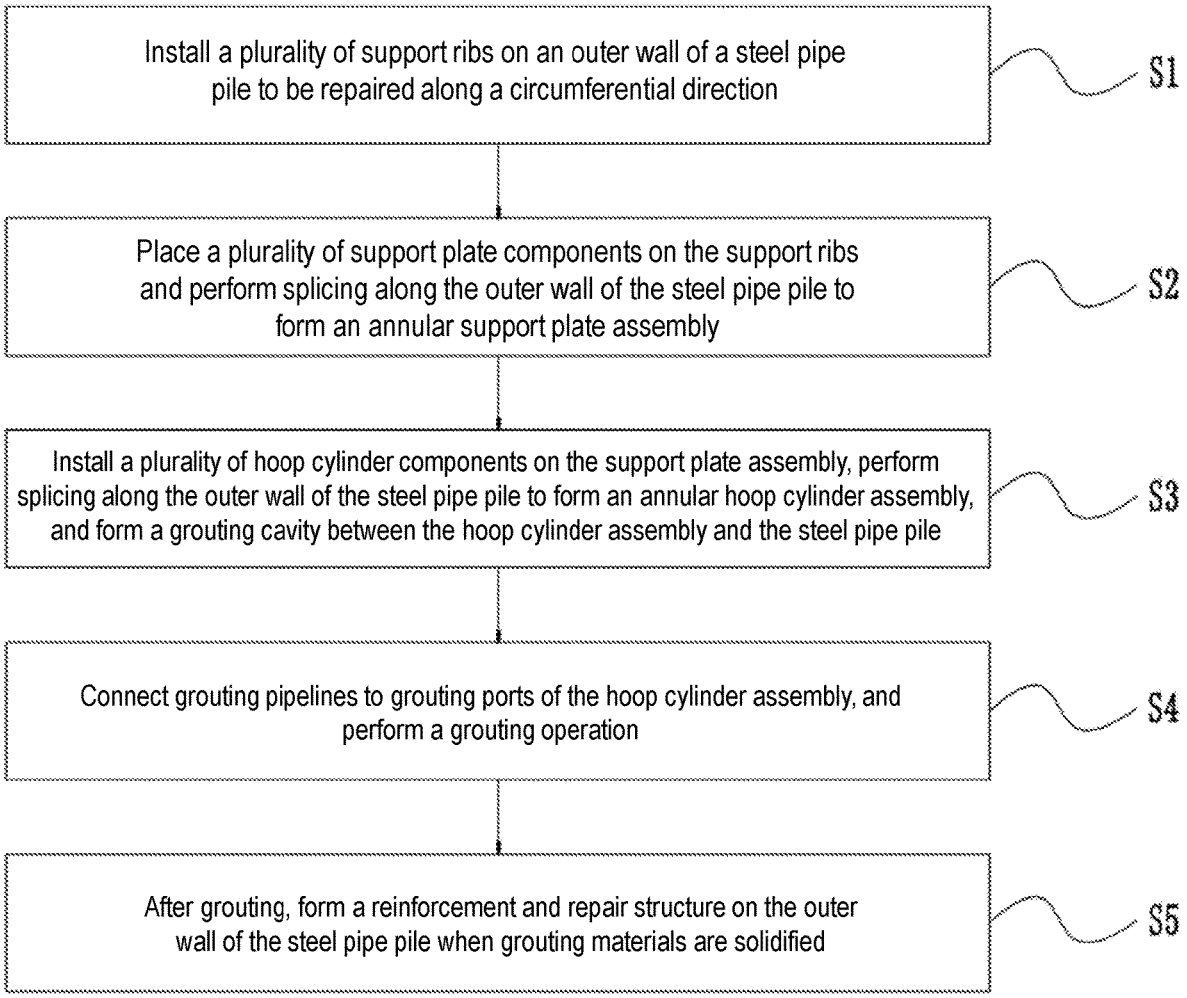
FIG. 1 is a flow chart of the present invention.
Figure 2:
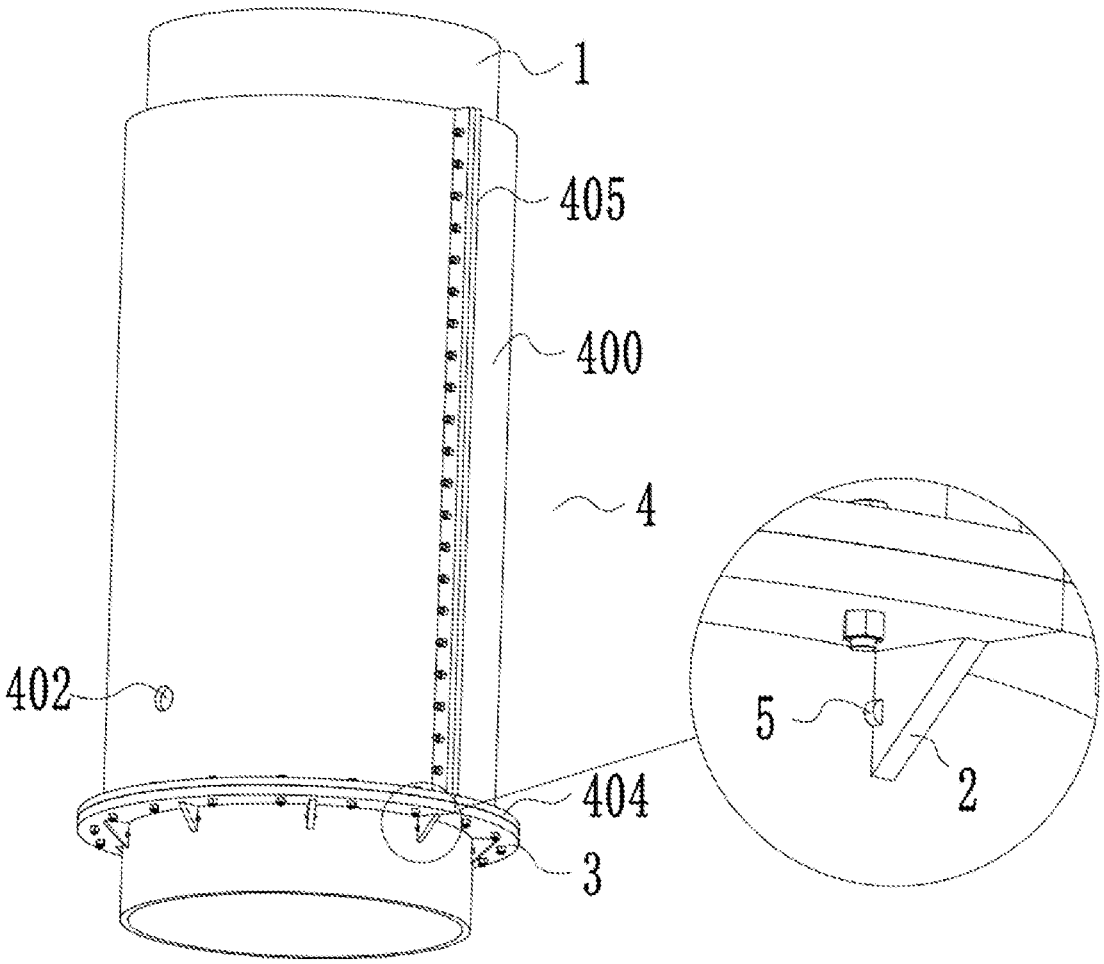
FIG. 2 is a schematic structural diagram of a grouting device used in the present invention in a usage status.
Figure 3:
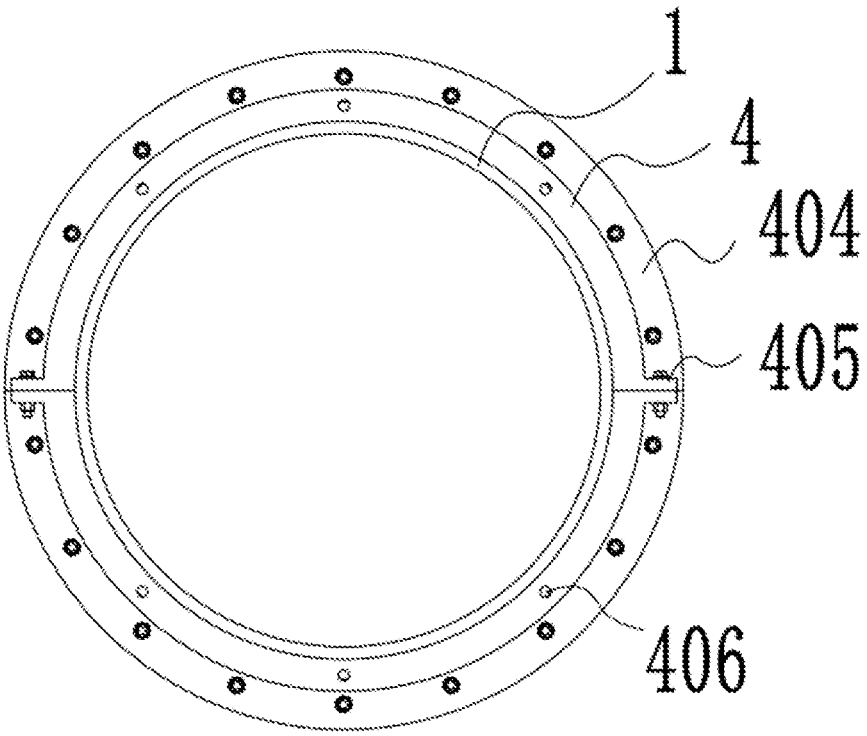
FIG. 3 is a schematic diagram of a top-view structure of the grouting device used in the present invention in the usage status.
Figure 4:
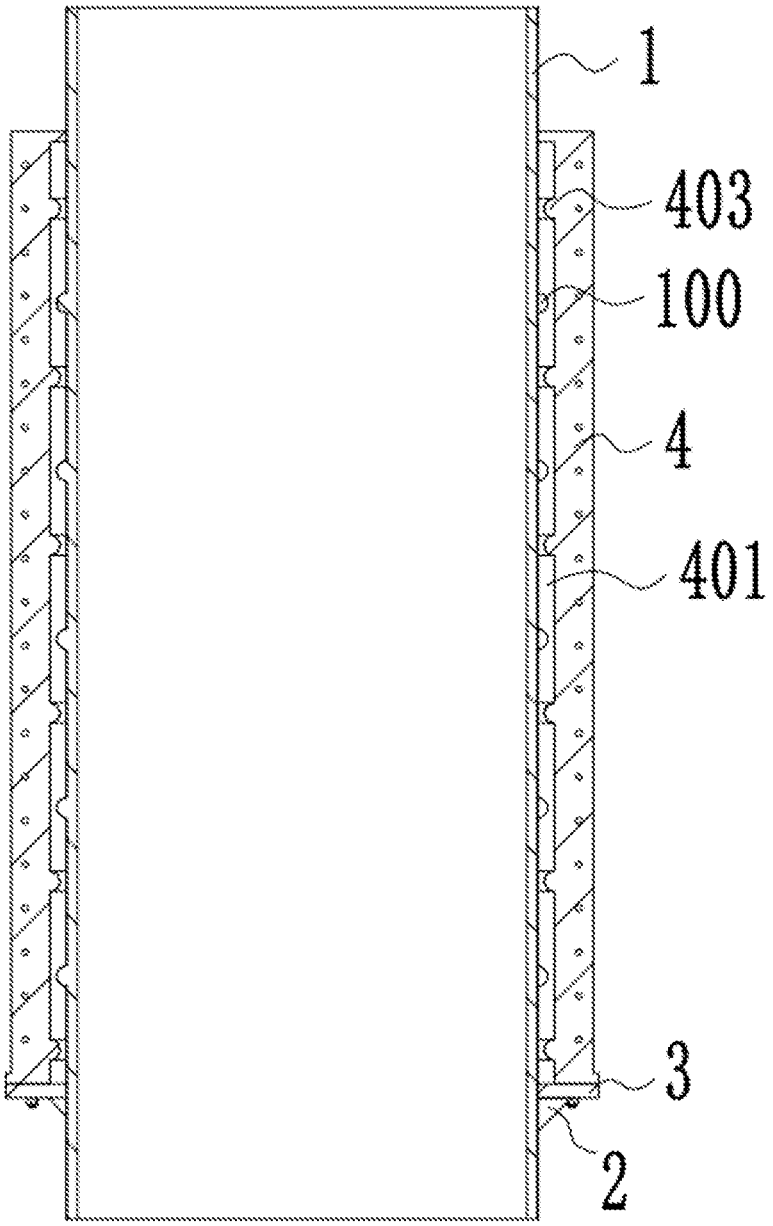
FIG. 4 is a schematic diagram of a cross-sectional structure of the grouting device used in the present invention in the usage status.
Figure 5:
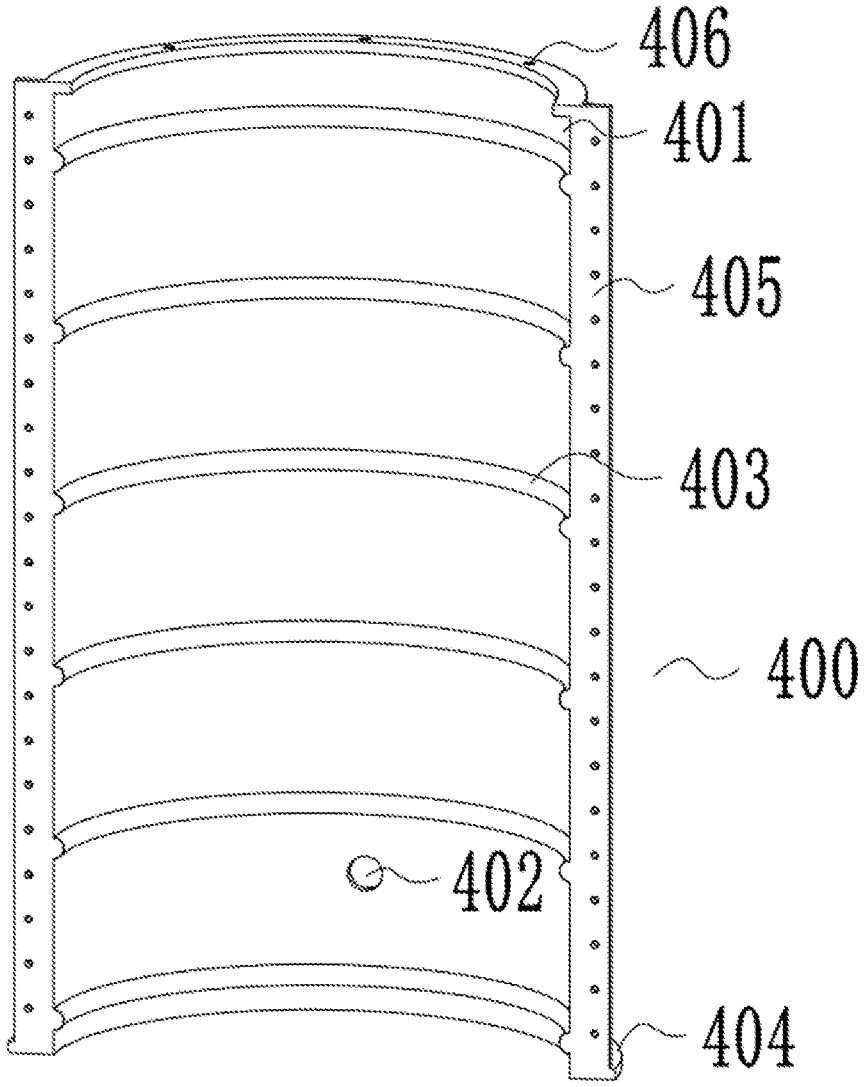
FIG. 5 is a schematic structural diagram of a hoop cylinder component in the present invention.

Referring to FIG. 1 to FIG. 5, a construction method for reinforcing and repairing a steel pipe pile for offshore wind power is implemented by using a grouting device. The grouting device includes structures such as support ribs 2, a support plate assembly 3, a hoop cylinder assembly 4, magnetic adsorption pieces 5, etc. Before construction, the damaged steel pipe pile 1 is detected, the structure of the grouting device is designed and selected according to a field detection report, and anti-corrosion measures are well made. During construction, the damaged steel pipe pile 1 is subjected to line drawing to determine the installation position of the grouting device.

The method includes the following steps.

Step S1: a plurality of support ribs 2 are installed on an outer wall of a steel pipe pile 1 to be repaired along a circumferential direction, and the support ribs 2 are uniformly distributed circumferentially.

Specifically, the support ribs 2 are of a stable triangular plate structure, each of the support ribs 2 is fixedly provided with a magnetic adsorption piece 5, and the magnetic adsorption piece 5 is internally installed with a magnet. Before welding, the magnetic adsorption pieces 5 are firstly adsorbed on the outer wall of the steel pipe pile 1 to pre-position the support ribs 2, and then the support ribs 2 are welded.

Step S2: a plurality of support plate components are lifted by a crane, and the support plate components are placed on the support ribs 2 and spliced along the outer wall of the steel pipe pile 1 to form an annular support plate assembly 3.

Specifically, the support plate assembly 3 includes two support plate components, the support plate components are of a half ring structure, the support plate components are provided with lifting lugs for lifting, and the two support plate components are integrally welded end-to-end on the support ribs 2, and the support plate components are also welded with the steel pipe pile 1. When necessary, the support plate components and the corresponding support ribs 2 may also be welded and fixed.

The number of the support plate components in the above-mentioned support plate assembly 3 may be adjusted as required.

Step S3: a plurality of hoop cylinder components 400 are lifted by the crane, the hoop cylinder components 400 are installed on the support plate assembly 3 and spliced along the outer wall of the steel pipe pile 1 to form an annular hoop cylinder assembly 4, and a grouting cavity 401 is formed between the hoop cylinder assembly 4 and the steel pipe pile 1.

Specifically, the hoop cylinder assembly 4 includes two hoop cylinder components 400, the hoop cylinder components 400 are of a semi-cylindrical structure, the hoop cylinder components 400 are provided with lifting lugs for lifting, the bottom portion of each of the hoop cylinder components is provided with a flange 404, the flanges 404 and the support plate assembly 3 are fixed by high-strength fasteners, left and right sides of each of the hoop cylinder components 400 are provided with connecting plates 405, the connecting plates 405 of the two hoop cylinder components 400 are connected by high-strength fasteners, an inner wall of each of the hoop cylinder components 400 is formed with a grouting cavity 401, the inner wall of each of the hoop cylinder components 400 is provided with a plurality of first reinforcement keys 403 spaced from top to bottom, an upper end of the inner wall of each of the hoop cylinder components 400 is provided with a boss, the boss is used as an upper flange of the grouting cavity 401, and the boss is formed with a plurality of grout overflow ports 406.

The number of the hoop cylinder components 400 in the above-mentioned hoop cylinder assembly 4 may be adjusted as required.

Step S4: grouting pipelines are connected to grouting ports 402 of the hoop cylinder assembly, a grouting operation is performed from bottom to top, and the grout overflow ports 406 are concerned all the time, such that whether the grouting operation is completed is judged by observing whether grouting materials overflow from the grout overflow ports 406 during grouting.

Step S5: after grouting, when the grouting materials are solidified, a grouting device is left on the steel pipe pile 1, and a reinforcement and repair structure is formed on the outer wall of the steel pipe pile together with the grouting materials.

In addition, a plurality of second reinforcement keys 100 can be welded from top to bottom on the outer wall of the steel pipe pile 1 in advance, a welded part is an undamaged part of the steel pipe pile 1, the first reinforcement keys 403 and the second reinforcement keys 100 are arranged in a staggered manner, and the first reinforcement keys 403 and the second reinforcement keys 100 are capable of preventing the hoop cylinder assembly 4 from sliding down.

Other embodiments of the disclosure will be apparent to those skilled in the art from consideration of the specification and practice of the disclosure disclosed herein. The disclosure is intended to cover any variations, uses or adaptations of the disclosure. These variations, uses, or adaptations follow the general principles of the disclosure and include common general knowledge or conventional technical means in the art that are not disclosed in the present disclosure. The specification and embodiments are illustrative, and the real scope and spirit of the present disclosure is defined by the appended claims.

It should be understood that the disclosure is not limited to the precise structures that have been described above and shown in the drawings, and various modifications and variations can be made without departing from the scope thereof. The scope of the disclosure is limited only by the appended claims.

What is claimed is:

1. A construction method for reinforcing and repairing a steel pipe pile for offshore wind power, the construction method comprising the following steps:

step S1: installing a plurality of support ribs on an outer wall of a steel pipe pile to be repaired along a circumferential direction, wherein the support ribs are fixed to the outer wall of the steel pipe pile by welding; and, magnetic stick pieces are fixed to the support ribs and attached to the outer wall of the steel pipe pile, such that the support ribs are pre-positioned, and that the support ribs are welded;

step S2: placing a plurality of support plate components on the support ribs and connecting the plurality of support plate components along the outer wall of the steel pipe pile to form an annular support plate assembly;

step S3: installing a plurality of hoop cylinder components on the support plate assembly, connecting the plurality of hoop cylinder components along the outer wall of the steel pipe pile to form an annular hoop cylinder assembly, and forming a grouting cavity between the hoop cylinder assembly and the steel pipe pile;

step S4: connecting grouting pipelines to grouting ports of the hoop cylinder assembly, and performing a grouting operation; and step S5: after grouting, forming a reinforcement and repair structure on the outer wall of the steel pipe pile when grouting materials are solidified.

2. The construction method for reinforcing and repairing a steel pipe pile for offshore wind power according to claim 1, wherein in the step S2, the plurality of support plate components are welded to form the support plate assembly.

3. The construction method for reinforcing and repairing a steel pipe pile for offshore wind power according to claim 1, wherein in the step S2, the support plate components are fixed to the outer wall of the steel pipe pile by welding.

4. The construction method for reinforcing and repairing a steel pipe pile for offshore wind power according to claim 1, wherein in the step S2, the support plate assembly comprises two said support plate components.

5. The construction method for reinforcing and repairing a steel pipe pile for offshore wind power according to claim 1, wherein in the step S3, the plurality of hoop cylinder components are connected by high-strength fasteners to form the hoop cylinder assembly.

6. The construction method for reinforcing and repairing a steel pipe pile for offshore wind power according to claim 1, wherein in the step S3, a bottom portion of the hoop cylinder assembly is connected to the support plate assembly by high-strength fasteners.

7. The construction method for reinforcing and repairing a steel pipe pile for offshore wind power according to claim 1, wherein in the step S4, an upper end of the hoop cylinder assembly is formed with grout overflow ports, such that whether the grouting operation is completed is judged by observing whether the grouting materials overflow from the grout overflow ports during grouting.

8. The construction method for reinforcing and repairing a steel pipe pile for offshore wind power according to claim 1, wherein an inner wall of the hoop cylinder assembly is provided with first reinforcement keys; the outer wall of the steel pipe pile is welded with second reinforcement keys; and the hoop cylinder assembly is installed on the steel pipe pile.

* * * * *